US006443849B1

(12) United States Patent
Byrd

(10) Patent No.: US 6,443,849 B1
(45) Date of Patent: Sep. 3, 2002

(54) RECREATION SYSTEM WITH RAIN FOREST THEME

(75) Inventor: Daniel V. Byrd, Ft. Payne, AL (US)

(73) Assignee: Playcore, Inc., Janesville, WI (US)

( * ) Notice: Subject to any disclaimer, the term of this patent is extended or adjusted under 35 U.S.C. 154(b) by 0 days.

(21) Appl. No.: 09/592,152

(22) Filed: Jun. 12, 2000

(51) Int. Cl.[7] ..... A63G 21/100

(52) U.S. Cl. ..... 472/116; 472/117; 472/64; 482/35

(58) Field of Search ..... 472/116, 117, 472/136, 81, 64; 482/35, 36, 148; 434/150, 151; D21/811, 814, 826, 818, 820; 52/169.2, 174, 175; 428/15, 17, 18

(56) References Cited

U.S. PATENT DOCUMENTS

| | | | | | |
|---|---|---|---|---|---|
| D250,784 | S | | 1/1979 | Dieter et al. | D34/5 E |
| 4,379,551 | A | | 4/1983 | Ahrens | 272/56.5 R |
| 4,855,167 | A | * | 8/1989 | Biehl | 428/18 |
| 5,085,900 | A | * | 2/1992 | Hamlett | 428/18 |
| 5,221,565 | A | * | 6/1993 | Johnson | 428/17 |
| 5,226,864 | A | | 7/1993 | Showers | 482/35 |
| 5,316,516 | A | * | 5/1994 | Saitoh, Shinya | 40/414 |
| 5,326,337 | A | * | 7/1994 | Pardella | 482/36 |
| D361,116 | S | | 8/1995 | Shaneour | D21/244 |
| 5,554,074 | A | | 9/1996 | Von Parrish | 472/116 |
| 5,611,176 | A | * | 3/1997 | Juengert et al. | 52/40 |
| 5,685,778 | A | * | 11/1997 | Sheldon et al. | 472/128 |
| 5,711,744 | A | | 1/1998 | Strawcutter et al. | 482/35 |
| 5,820,471 | A | | 10/1998 | Briggs | 472/128 |

* cited by examiner

*Primary Examiner*—Kien T. Nguyen
(74) *Attorney, Agent, or Firm*—Welsh & Katz, Ltd.

(57) ABSTRACT

A recreation system resembling a jungle scene is provided with platform elements surrounded by and elevated by support members disguised to look like bamboo rods and tree branches with leaves. The support elements are generally made of pipe materials covered with foam and plastic cable ties so as to resemble bamboo. The tree branch elements are interlocking members designed to appear as tree branches and are changeable to allow for different configurations of tree elements by pulling the present elements apart and then pushing them together in other configurations. The recreation system includes jungle and bird noises and simulated lightning and thunder which are activated during play on the recreation system. The recreation system allows the user to pretend to be in a jungle setting during play.

10 Claims, 13 Drawing Sheets

RECREATION SYSTEM WITH RAIN FOREST THEME

FIELD OF THE INVENTION

The present invention concerns a novel recreation system that allows children to play in a rain forest-like surrounding providing structural and decorative elements that resemble bamboo, trees and leaves.

BACKGROUND OF THE INVENTION

Children's recreation centers such as jungle gyms, swing sets, tree houses and forts are common on playgrounds, back yards, public parks and recreation centers. However, most of these recreation systems are designed for functionality, displaying the structural elements on which children are to climb upon and play within. Most such systems do not include aspects that make the recreation system whimsical or fin on its own nor do they include aspects which cause a child to recall an exotic or exciting scene which aids in fostering imagination.

In many prior art climbing systems, metal pipes are welded together in various forms or structural wood is assembled to allow the user to climb about the system. The staid backyard tree house or fort is generally built with scrap lumber which allows the user to enter the system and play therein. Newer versions of jungle gyms, tree houses and forts are generally sparse in decoration and only provide such amusements as slides, towers, tubes and ball pits. However, a utilitarian overall look generally prevails in these systems. Because of the general harshness and utility of these environments, these recreation venues are usually reserved for older, school-aged, children. Further, because these systems are made for older children, the needs of younger children, for imaginative play surroundings allowing for the exercise of the imagination and the body, are often ignored. Often times when recreation systems are devised for younger children they generally resemble gerbil tubes for kids rather than the creative and fun environments necessary for imaginative play.

I have invented a recreation system having aspects of traditional jungle gyms, tree houses and forts which also provides elements necessary to spark the imagination, and allows for play by both younger children and more mature children. In my invention, elements for climbing are provided along with platforms for standing and playing upon along with slides, mirrors, mazes, ladders, games and educational elements. Different venues and sets of play elements may be assembled and joined together to allow play over a wide area and in three dimensions. The supports of the present system are designed to carry a deck or platform, are padded for safety and decorated to look like elements of a rain forest. Platforms, landings and walkways of the present invention are padded allowing for comfort and safety. Further, decorative components and sound effects are provided which help the user imagine exotic locations and exciting scenarios.

It is therefore an object of the present invention to provide a recreation system that is strong, durable and safe for children of all ages.

It is a further object of the present invention to provide a recreation system that comprises a large number of entertainment venues, within the play area, utilizing traditional play elements dressed up in a whimsical manner.

It is a further object of the present invention to provide a recreation system that resembles a rain forest or jungle scene.

It is a further object of the present invention to provide structural and decorative members made of tubular material and covered in padding, such that the supporting members resemble bamboo, and decorative components resemble rain forest plants.

Other objects and advantages of the present invention will become apparent as the description proceeds.

SUMMARY OF THE INVENTION

In accordance with the present invention, a recreation system comprising at least one platform for sustaining the weight of at least one person is provided. Support members elevating the platform above a surface are also provided, with the support members being extendable above the platform. The support members are made to resemble tree branches, tree trunks and tree roots, as well as bamboo. Further a number of decorative components are provided in the recreation system such that the recreation system resembles a rain forest or jungle scene. In the preferred embodiment of the present invention platforms and other play areas are designed to support the weight of a plurality of children at play.

The support members of the recreation system are comprised of pipe materials, such as PVC pipe, steel pipe, copper pipe or other pipe materials, covered in colorful padding materials, such as foam (formed of plastic, rubber or other impact cushioning materials) wrapped about the pipe material. The padding material is fixed to the support member by plastic cable ties, of types that are well known and widely available, which enhance the appearance of the support member by emulating the natural joints in bamboo. In the preferred embodiment of the present invention the support members are made of PVC pipe to provide structural strength while lowering the overall weight and cost of the recreation system of the present invention.

In the preferred embodiment of the present invention, numerous platform levels are provided in a number of structures. The structures and platforms levels are joined together, by communicating structures (such as bridges, balance beams and walkways), so that play on various levels may occur simultaneously. The use of numerous platforms and structures, further, provides play space for large numbers of children. The various platform levels are dressed to provide the appearance of such venues as a jungle tree house, a jungle fortress and a helicopter landing pad.

In the preferred embodiment, the jungle scene is completed by the use of artificial tree branches and leaves attached to the support members. The tree branches are provided with a skeletal structure, comprised of a thin rigid element covered in a padded outer bark and sustaining a plurality of twigs and artificial leaves. In the preferred embodiment of the present invention, numerous variations in the shape of the skeletal structure, bark, twigs and leaves may be made such that a plurality of different shaped branches, as generally found in nature, may be made. The tree branch structure so defined generally gives the impression of a real tree branch. In the illustrated embodiment of the present invention, tree shapes, such as tree trunks and roots, are also used to form entry ways into the interior of the recreation system and supporting members for play structures.

The preferred embodiment of the recreation system also comprises elements such as steps, slides, walls, protective meshing and other aesthetic, play and safety elements which may be installed in any number of desirable shapes and manners and on or near other play structures to provide entertainment as well as security, safety and decoration.

Further, the preferred embodiment includes means of providing jungle sounds, such as sound systems and speakers attached to motion or sound detectors, that cause appropriate recorded or artificially produced sounds to be generated when triggered. Such sounds as bird song, birds chirping, helicopter sound (for those systems including a helicopter deck) thunder claps and general jungle sounds provide a more realistic rain forest setting for the enjoyment of the users. Also, lighting effects may be added to simulate such events as lightning strikes or even sunrise, sunset or other celestial and astronomical events. The sound and lighting effects, in the preferred embodiment of the present invention, are triggered, using motion, vibration and sound sensors, as a result of the play of children in the vicinity of the sensors. While motion and sound detectors provide the preferred method of triggering the sounds and lighting generated in the present invention, it is to be understood that any manner of triggering sounds and lighting effects, such as trip mechanisms or timers, may be used by persons skilled in the art without departing from the novel scope of the present invention.

It is noted that the preferred embodiment of the recreation system illustrated and described herein is the result of creativity and innovation in compliance with ASTM F1918-98 standards and the Americans with Disabilities Act.

A more detailed explanation of the invention is provided in the following description and claims and is illustrated in the accompanying drawings.

DETAILED DESCRIPTION OF THE ILLUSTRATIVE EMBODIMENT

Figure 1:
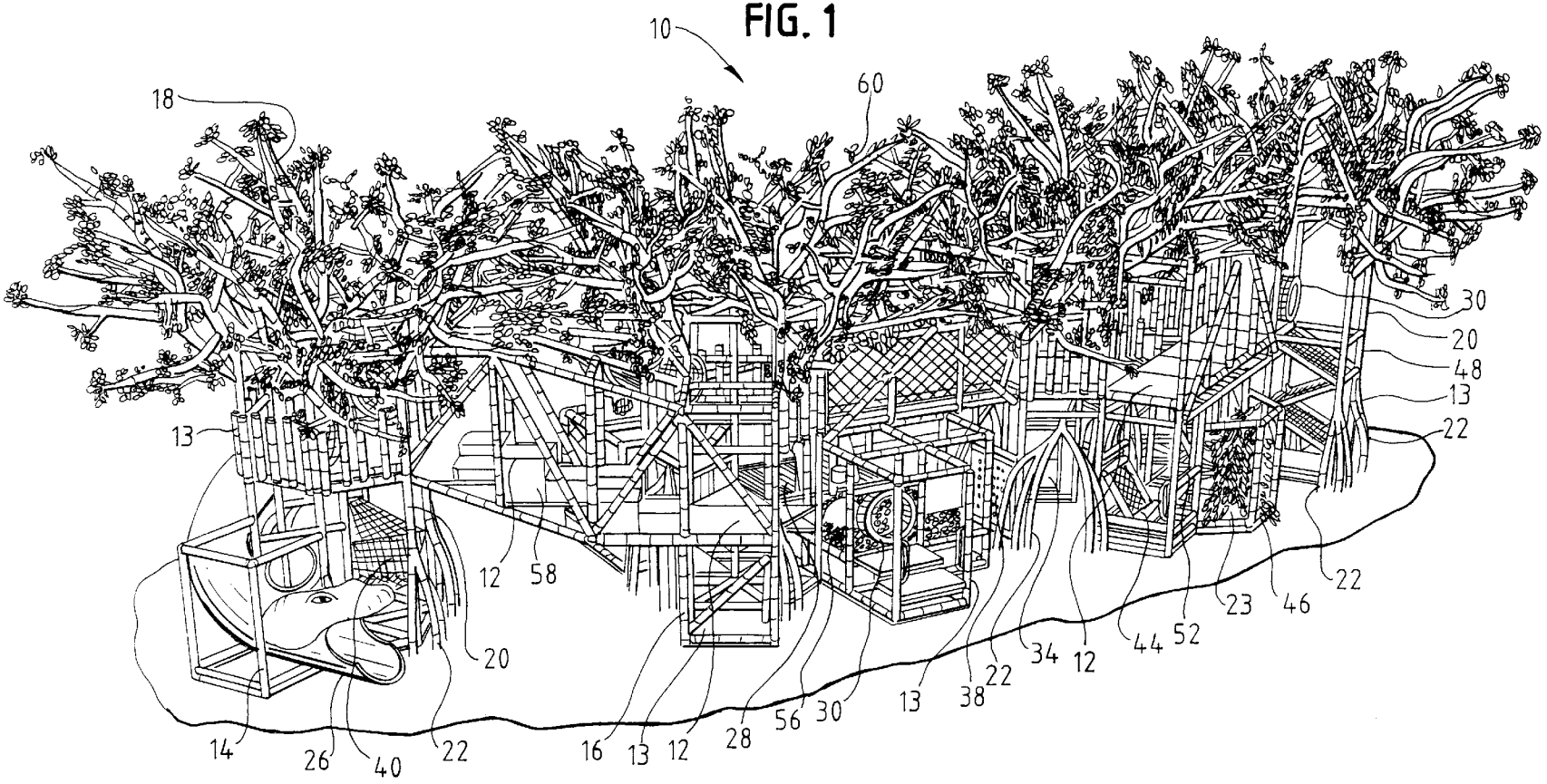
FIG. 1 is a perspective view of a recreation system made in accordance with the principles of the present invention.
Figure 1A:
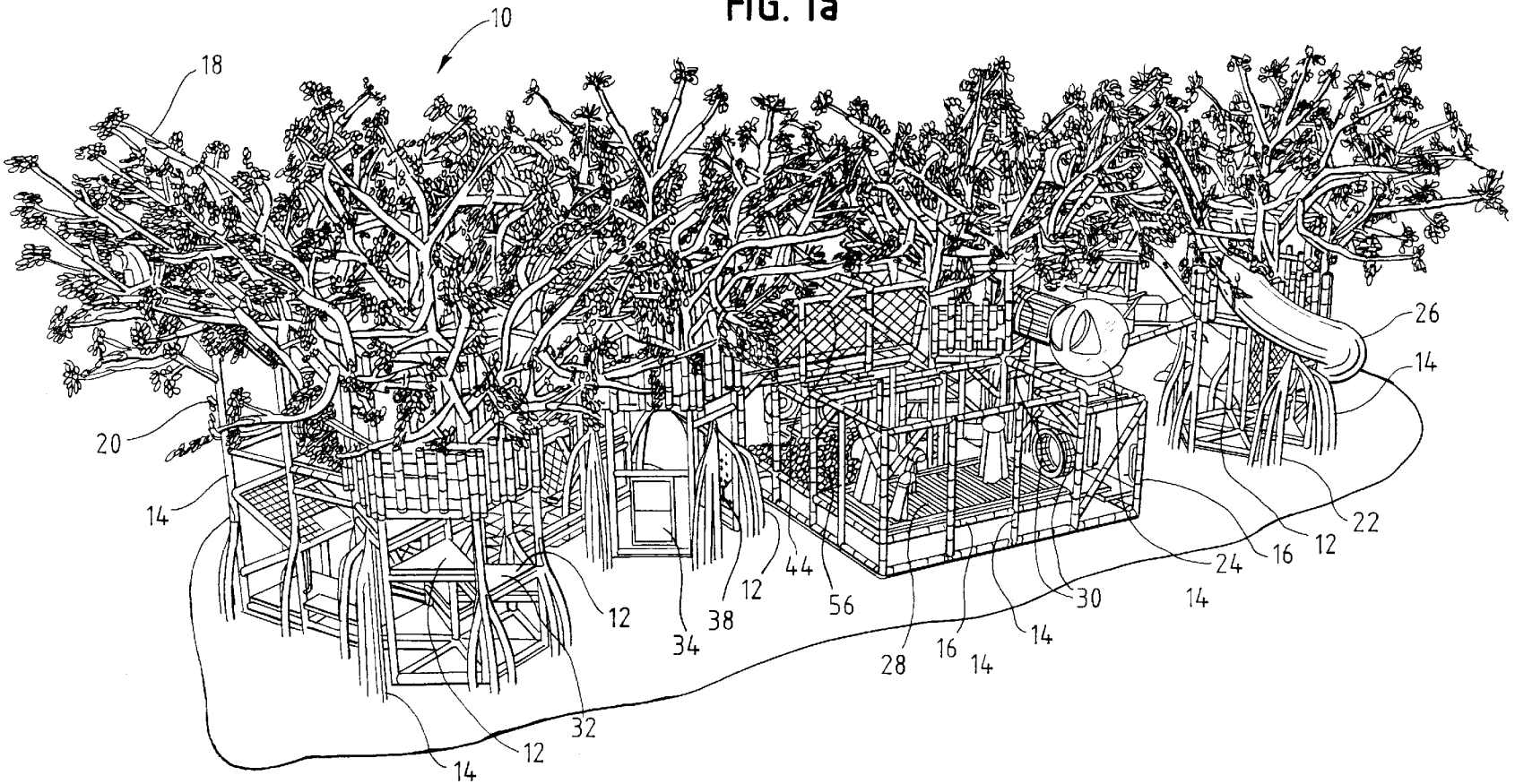
FIG. 1*a* is a perspective view of the recreation system of FIG. 1, as viewed from another angle.

Referring to the drawings, a recreation system 10 comprising a number of platforms 12 on various structures 13, supported by structural elements 14 is shown. Recreational system 10 has the unique feature of having support structural elements 14 which are dressed to appear as bamboo 16. Other elements of recreation system 10, both structural and decorative, are dressed to look like tree branches 18, tree trunks 20 and roots 22, as will be explained in greater detail below. A number of play and decorative components, may be seen in FIGS. 1, 1*a* and 2 including: ferns and small plant decorations 23, a helicopter 24, a large snake (anaconda) slide 26, a trampoline-like bouncing system 28, crawling tubes 30, spiral stairs 32, a wavy mirror panel 34, a maze panel 36, a counting and spelling educational panel 38, a spiral cargo net climb 40, several telescopes 42, several beam walks 44, a cargo bridge 46, a zig zag tower 48, a shuttle 50, several camo trees 52, a foam forest walk 54, a ball bath 56, a mountain run platform 58, numerous nettings for climbing 60 and netting for decorative cover (not shown), as well as other play components. Further, sound and light elements, which are triggered by the play of children, within recreation system 10, are provided and will be explained in greater detail below.

Figure 2:
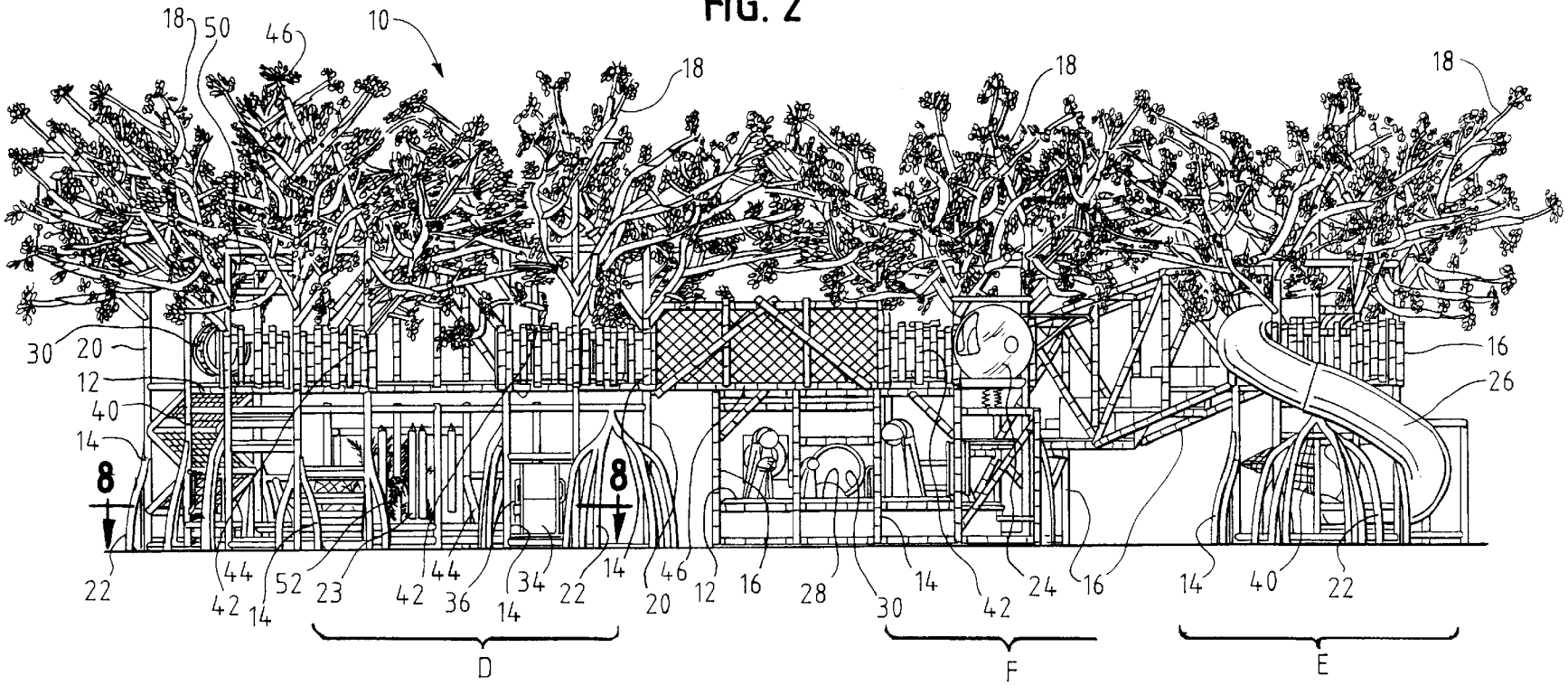
FIG. 2 is an elevational view of the recreation system of FIG. 1.
Figure 3:
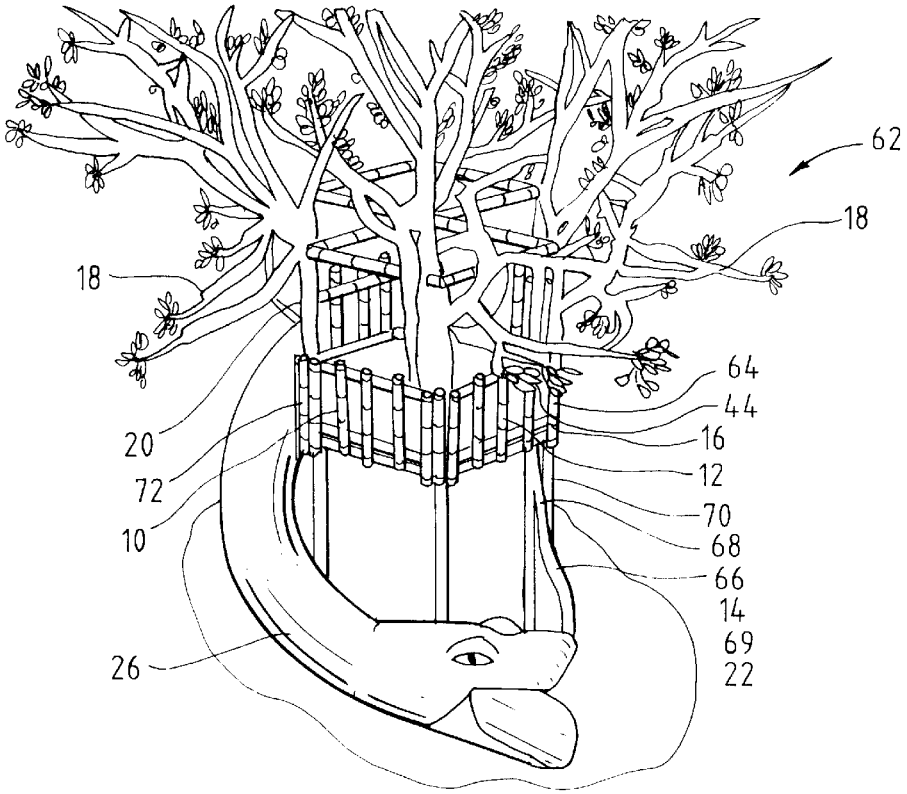
FIG. 3 is a perspective view of a second embodiment of a recreation system made in accordance with the teachings of the present invention.

While a recreation system of the present invention may comprises any number of the above components or all of them, a more simple version, as shown in FIG. 3, may be constructed without departing from the novel scope of the present invention. FIG. 3 shows a recreation system 62 built in accordance with the principles of the present invention, comprising only a small part of the larger recreation system 10 shown in FIGS. 1, 1*a* and 2. While a single structure 13 of the recreation system 10 is shown in FIG. 3, it is to be understood that recreation systems comprised of any number, all, or more than all (i.e. some duplicates) of the components shown in FIGS. 1, 1*a* and 2 may be constructed without departing from the novel scope of the present invention. In FIG. 3, a tower 64, built within tree branches 18 having a platform 12 and bamboo-like railing 14 is shown. Decorative tree branches 18 are an important part of the present invention. Tree branches 18 are found in all sections of recreation systems 10 and 62 and, in the illustrative embodiment, are made to closely resemble real tree branches in nature. The manner of constructing tree branches 18 so that they closely resemble natural branches is explained in greater detail below. Recreation system 62, further includes a large snake (anaconda) slide 26 as well a spiral staircase 66 made with netting 68. FIG. 3 illustrates that while many of the individual tower elements of the recreation system 10 may be used as independent recreation systems, the joinder of a number of individual recreation systems towers may produce a synergistic effect of providing entertainment on and between the various recreation system towers.

It may be seen, in FIG. 3, that recreation system 62 is provided with a storage compartment 69, in which the users may store their shoes during play. It is to be understood that while one shoe storage compartment 69 is provided in recreation system 62, a proportionate number of shoe storage compartments 69 (for use by the larger number of participants) may be provided for a larger system, such as system 10 of FIGS. 1, 1*a* and 2, without departing from the novel scope of the present invention.

Figure 4:
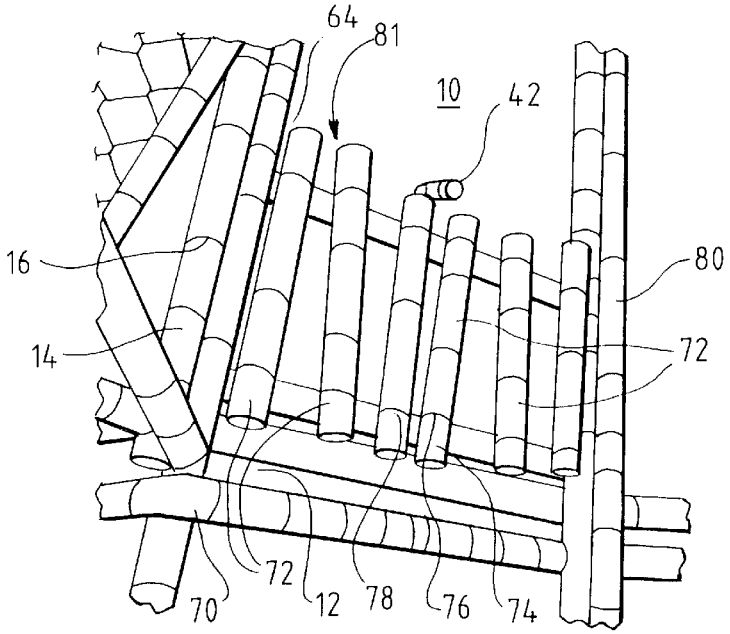
FIG. 4 is a perspective view of a structural and decorative members decorated to look like bamboo.

As shown in FIG. 3, and more closely in FIG. 4, a number of supporting members 70 and rail members 72 of tower 64 are comprised of what appears to be bamboo. Bamboo are any of a variety of grasses including some with strong hollow-stems used for buildings, furniture and utensils (Merriam-Webster English Dictionary © 1974 G & S Merriam Co., p. 68). In the present invention, structural member 70 is preferably comprised of pipe (made of PVC or metal). It is to be understood that the structural elements of the present invention may be made of any type of structural member generally used in the construction of recreation systems and other structures. Such elements as metal bars, rebar, I-beams (and other structural steel sections), structural wood or other structural members may be used in the present invention without departing from the novel scope of the present invention. Structural members 14 (FIGS. 1, 1*a* and 2) and 70 are wrapped in padding material 74 and cable ties 76, of a well known self-locking type, are placed around padding 74 and tightened to secure padding 74 to structural members 14 and 70. Cable ties 76 provide the visual joints 78 common in bamboo while securing padding 74 to structural members 14. The use of structural elements dressed to look like bamboo gives the user a sense of being in a rain forest and promotes the use of the imagination and imaginative play. In the preferred embodiment of the present invention, padding 74 is an exterior plastic foam molded to have a shape easily fitting around a structural pipe member 14, 70, and molded of a color reminiscent of the color of bamboo. It is to be understood that any type of padding material that may be wrapped around structural member 14 and tied with cable ties 76, and of any color, may be used without departing from the novel scope of the present invention.

FIG. 4 shows a closer look at the "bamboo" members in recreation system 62. In FIG. 4 a platform 12 is shown having support members 70 dressed as bamboo. While support members 70 comprise a pipe 14 (or other structural element) wrapped in padding material 74 and tied with cable ties 76 to look like bamboo, a non-structural, or decorative, railing section 81 comprised of railing members 72 may be made solely of padding material 74 and cable ties 76. In decorative railing sections 81 padding material 74 is rolled into a tube shape and fastened with cable ties 76, without including a structural support member 14. By not including structural members 14 in the merely decorative parts of railing section 81, the overall weight and costs of recreation system 10 are reduced. Through the use of netting (not shown) designed to keep the user away from railing section 81, decorative railing elements 72 may be made untouchable thereby allowing the exclusion of structural support elements 14. It is to be understood that rail elements 72 may be made with structural support elements 14 if desired without departing from the novel scope of the present invention.

Figure 5:
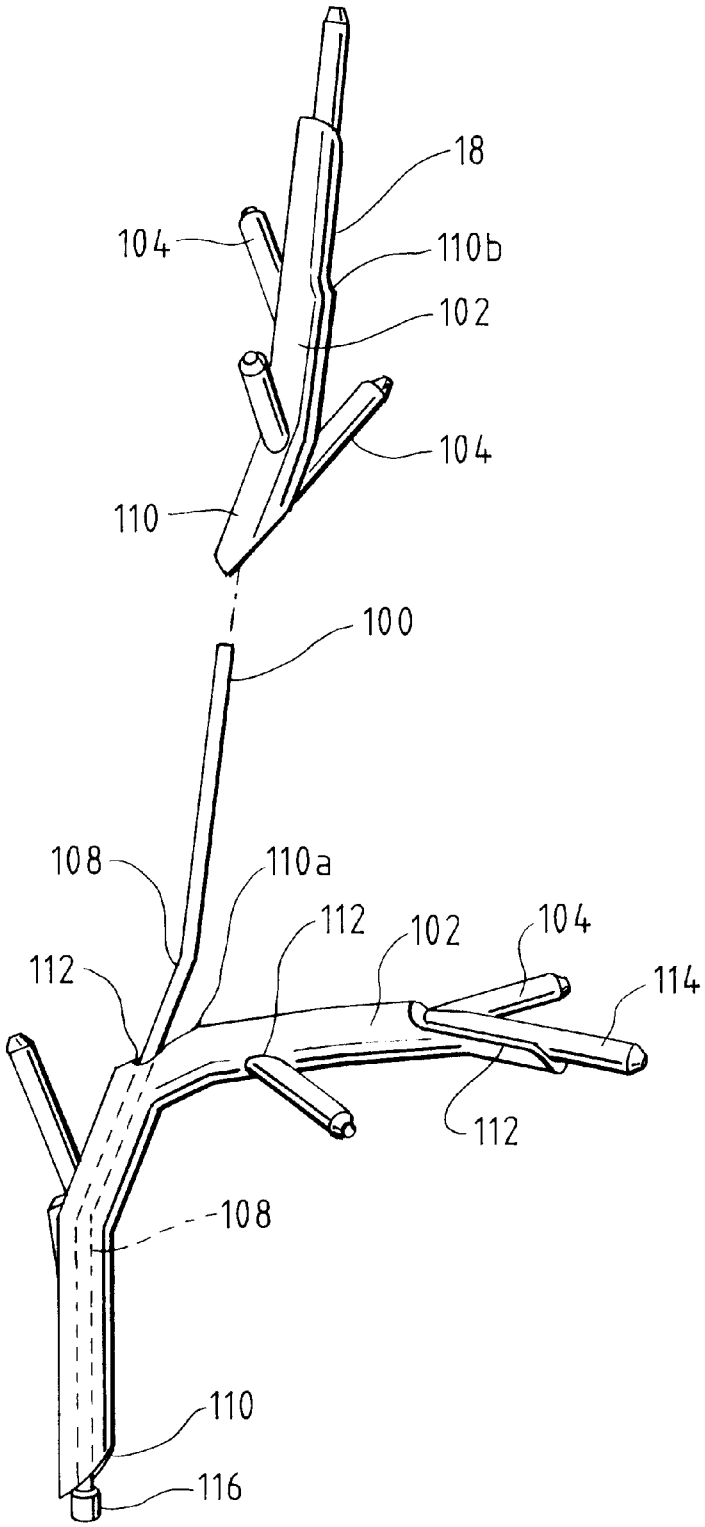
FIG. 5 is an exploded perspective view of the construction of a decorative member of the present invention dressed to appear as a tree branch.
Figure 6:
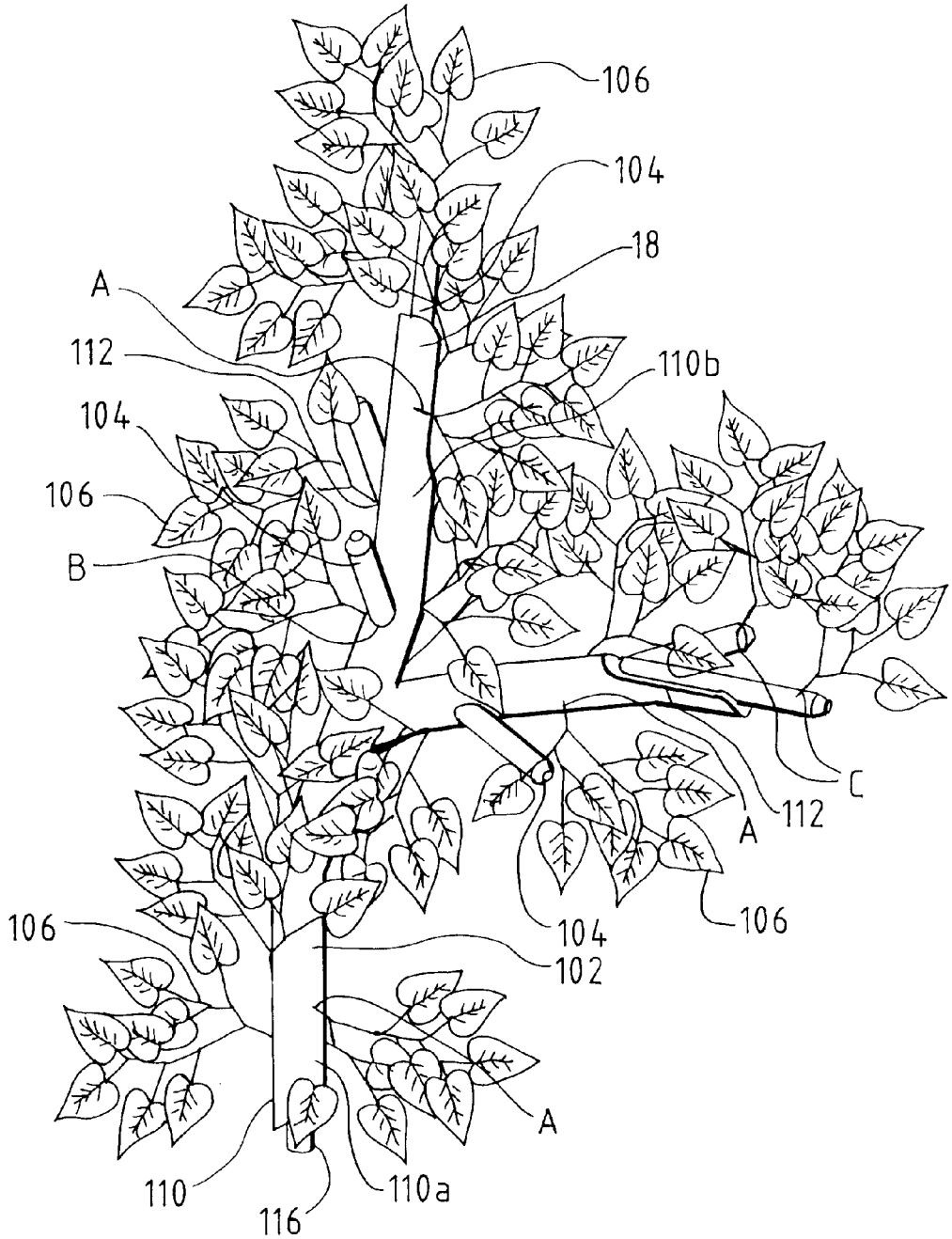
FIG. 6 is a perspective view of a decorative member of the present invention dressed to appear as a tree branch, including leaves.

Referring to FIG. 5, a detailed view of tree branch 18 is shown. Tree branch 18 is comprised of a skeletal member 100 covered in padding 102 and provided with twig elements 104 and leaves 106 (FIG. 6). In the preferred embodiment of the present invention, skeletal member 100 is generally in the form of a metal rod, however it is to be understood that the substitution of such materials as plastic and wood, and the use of such materials or other materials in other forms (including tubes, pipes, bars, rods or poles, any of which having any cross-section, including circular, rectangular, triangular or square) may be made without departing from the novel scope of the present invention. In FIG. 5, skeletal member 100 is shown (partially in phantom lines) having bends 108 along its longitudinal axis. It is to be understood that while one skeletal member 100 is shown and described, a skeletal member 100 of the present invention may include different, more severe, or greater numbers of bends 108, than shown in FIG. 5, to simulate any number of different tree branches found in nature without departing from the novel scope of the present invention. Such bends 108 provide a more natural appearance to branch 18 and allows for numerous variations in the placement of padding material 102 such that many different configurations of branches 18 may be made. In the preferred embodiment, padding material 102 is of a type similar to that used for bamboo sections 70, 72 and 81, however, it is to be understood that any type of material which may be cut and bent around skeletal member 100, including material that may not be padded or soft (such as materials more closely resembling tree bark, such as carved wood or hardened plastic pre-formed in appropriate shapes) may be substituted without departing from the novel scope of the present invention.

In the construction of tree branches 18, in the preferred embodiment of the present invention, padding 102, in the form of sheets of molded plastic foam, is cut into appropriate lengths, generally approximately 8 foot lengths and approximately 4 foot lengths so as to provide variation in branch lengths and allow for the making of forked branches of varying lengths. Padding 102 is formed generally into tube shapes 110 for placement onto skeletal member 102. Openings 112, in tube 110 are made to allow the placement of tube 110 onto skeletal member 102. Further a plurality of openings 112 in tube 10 are made to allow the placement of smaller branches 18 and twig elements 104. Tube 110 may have any number of openings 112 so that branch elements 102 may be placed in almost as many different arrangements as generally provided in nature. Twig elements 104 are generally formed of a bar of exterior plastic foam material, of the type used to create padding 102, having generally a circular cross section. Various lengths of the plastic foam material bar may be cut to resemble the various lengths of smaller branches and twigs found in nature. It is to be understood that twig elements 104 may be constructed of other materials, including hardened plastic, wood, metal or other materials, formed into rod shapes or other shapes resembling twigs, without departing from the novel scope of the present invention.

As can be seen in FIG. 5, a first padding tube 110*a* may be placed onto skeletal member 102 in such a way that skeletal member 102 emerges from an opening 112. A second padding tube 110*b* may then be placed onto the exposed part of skeletal member 102 such that a "forked branch", of a type often found in nature, is formed. Any number of variations of forked branches may be made in this manner using skeletal member 102 and padding tubes 110. When the placement of padding 102 requires that skeletal member 100 extend out of an opening 112, between the ends of padding tube 110, such that a realistic fork in a branch is produced, a lengthy portion of plastic foam material bar 114 may be cut and then inserted within that section of padding tube 110*a* that has been diverted from the length of skeletal member 100. In this manner the diverted part of padding tube 110*a* is provided with support means. Bar 114 may be cut so that the end within padding tube 110*a* may interact with skeletal member 100 to provide support for the extended part of branch 18. Further, sections of the foam material bar may be cut and hollowed out at one end such that skeletal member 100 may be inserted within the foam material bar so as to provide a finished end to skeletal member 100. Smaller twig elements 104 may fill any number of the openings in branch element 102 so as to provide a realistically full look to the branches.

FIG. 6 illustrates a completed branch showing padded elements 102 with twig elements 104 in place about skeletal member 100. Skeletal member 100 is provided with connectors 116 which allow the placement of the completed branches 18 onto tree trunks 20 (FIGS. 1, 1*a*, 2 and 3) and other members as desired. Leaves 106 may be placed in padding 102 as shown generally at "A", twig elements 104 as shown generally at "B" or within openings 112 defined in padding 102 as shown generally at "C". Further, the character of the play area encompassing tree branches 18 may be changed by changing the configuration of tree branches 18 from time to time. The adjustability of tree branches 18 allows recreation systems, made in accordance with the teachings of the present invention, to be continually changed so that they are always fresh and new.

Figure 7:
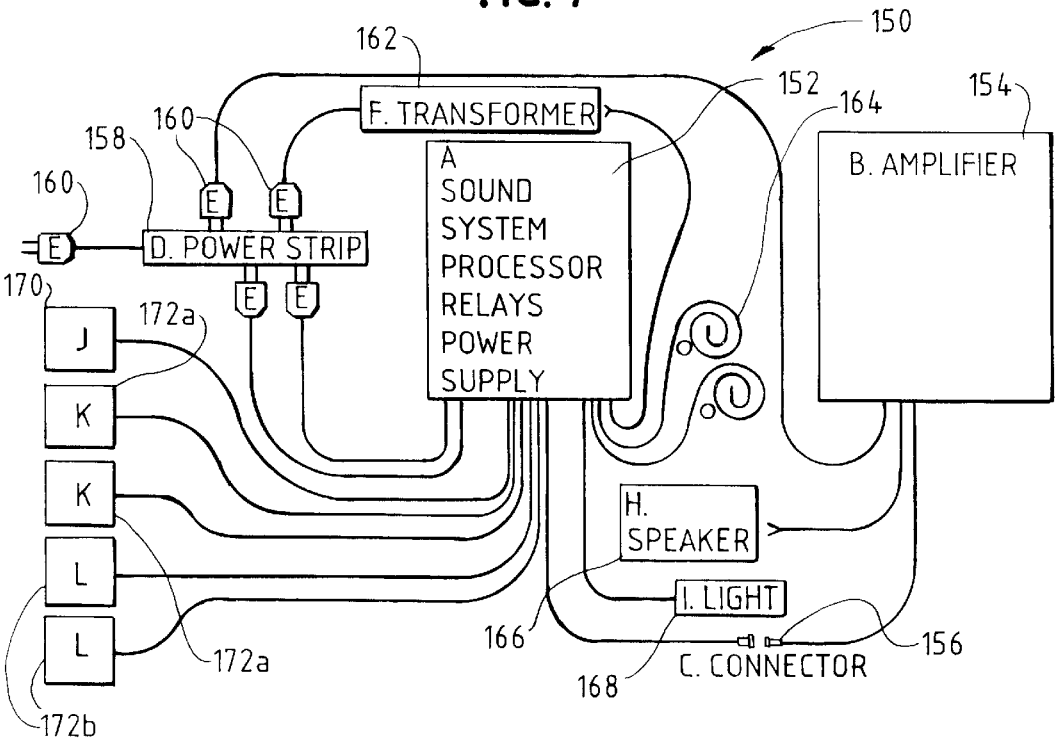
FIG. 7 is a schematic of a sound and lighting effects system used in the recreation system of FIG. 1.
Figure 8:
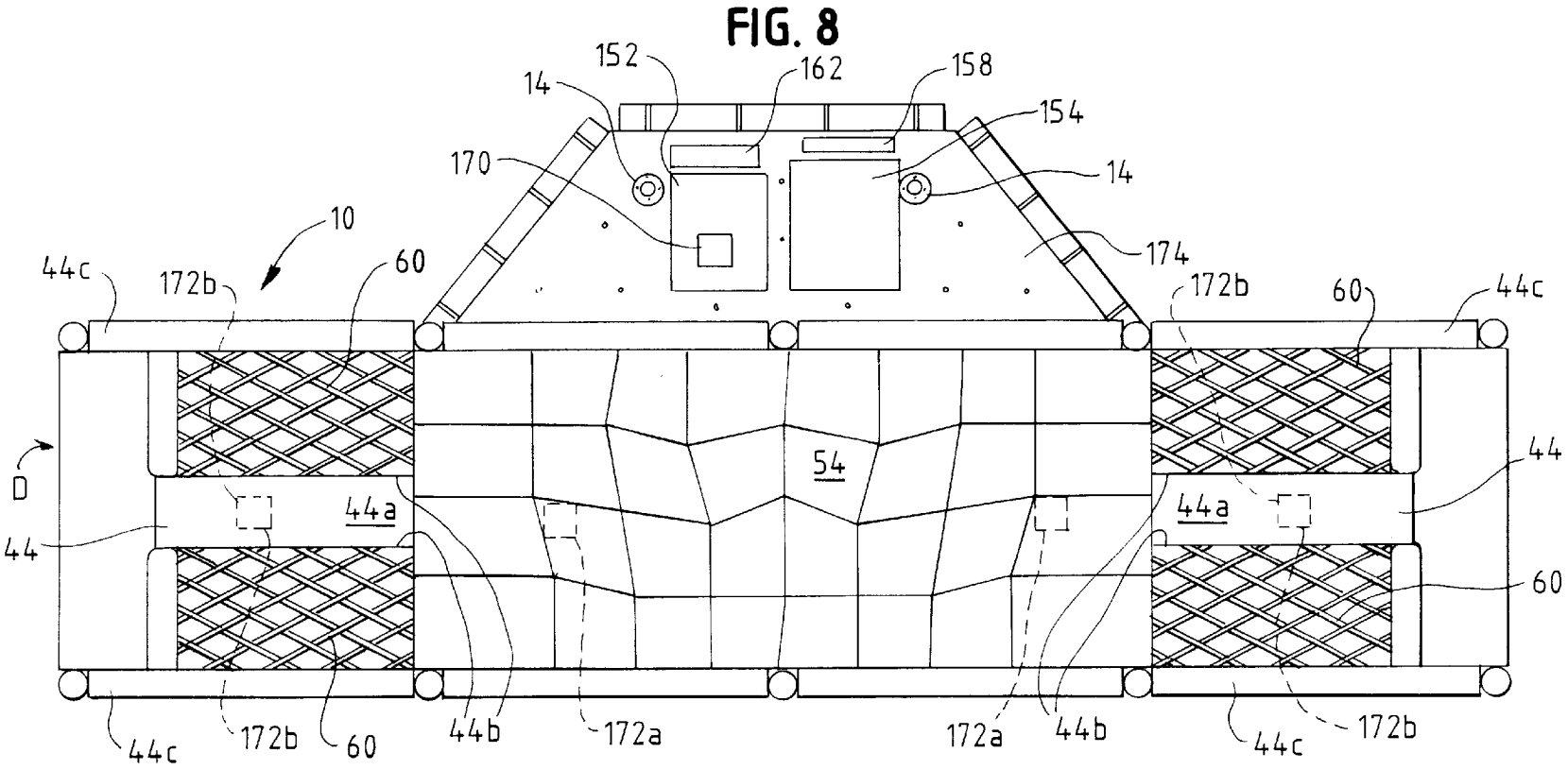
FIG. 8 is plan view of the layout of the system of FIG. 7, taken along the plane of lines 8—8 of FIG. 1.
Figure 9:
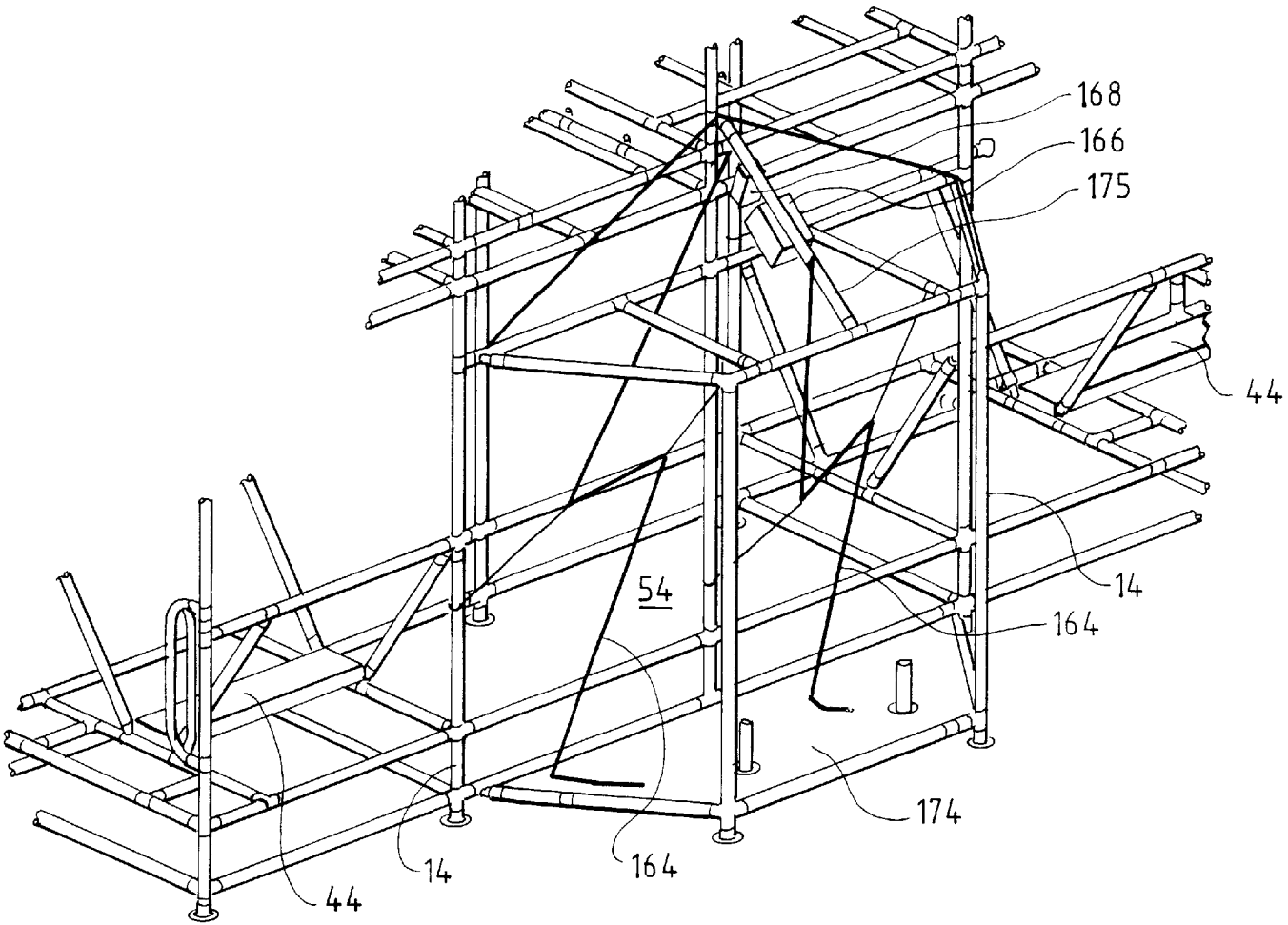
FIG. 9 is a perspective view of the layout of the system of FIG. 7.

The present invention enlarges the play experience by providing sound and light effects in recreation system 10. Referring now to FIG. 7, a schematic of a rain forest run sound system 150, used to detect the need for and provide sounds is shown. Sound system 150 comprises a sound system box 152, containing a sound system processor, relays and a power supply (all not shown). Sound system 150 further comprises an amplifier 154, connectors 156, a power strip 158, electrical plugs 160, transformer 162, rope lights 164, one or more speakers 166, a light fixture 168, a motion sensor 170 and vibration sensors 172*a* and 172*b*. FIGS. 8 and 9 show the placement of the components of sound system 150 in recreation system 10. In order to more clearly understand the enhancement to play systems provided by the inclusion of sound system 150 in the illustrative embodiment of the present invention, a more detailed description of the environs associated with sound system 150 will be discussed.

In FIG. 8 a cross section of a portion of recreation system 10, shown generally as section "D" in FIG. 2, is shown having the various elements of sound system 150 described above. Section D is generally divided into a forest bay section 174 and a foam forest section 176. The base of forest bay section 174 houses sound system box 152 and most of the electrical components needed to produce sound (described above). A motion sensor 170 is also housed in the base of forest bay section 174. Within forest bay section 174, rope lights 164, which comprise a string of small electrical bulbs which are caused to light up when energized such that a strip of light is produced, are strung on support members 14, within ferns and small plants 23, to resemble a bolt of lightning when energized. Further, speaker 166 and light fixture 168 are attached to the frame 175 of forest bay section 174 to add such effects, respectively, as thunder and lightning. Speaker 166, light fixture 168, motion sensor 170 and vibration sensors 172*a* and 172*b* may be attached by any conventional means to recreations system 10. In the preferred embodiment, these devices are attached using the cable ties 76, as previously described.

Foam forest section 176, as shown in FIG. 8, further comprises a set of play sections called beam walks 44, which generally provide the user with a narrow walking span to simulate a creaky rope bridge, or similar bridge, found over a river chasm or other treacherous obstacle which must be crossed. In one embodiment of the present invention, beam walks 44 are comprised of boards 44*a* and safety nets 60 extending from the base portions 44*b* of the beam walk boards 44*a*. A rail 44*c* is provided onto which safety nets 60 are attached so that the user of beam walks 44 may have hand support while crossing. Further, a vibration sensor 172*b*, of a type sensitive enough to sense the movement of a child on beam walk 44, is included on beam walk boards 44*a*, generally attached below boards 44*a*. While beam walk 44 is shown as a board, it is to be understood that beam walk 44 may be constructed of cloth, such as canvas, or other strong or reinforced material stretched between support members, without departing from the novel scope of the present invention. Further, a combination of boards and stretched cloth may be used, on different beam walks, in the same recreation system without departing from the novel scope of the present invention. The use of stretched material provides a cushioned path on which the user may walk. Further, the use of stretched material may also better emulate a flimsy jungle bridge or path than would a solid platform.

A foam forest-walk 54 is placed between the two beam walks 44 in the illustrated embodiment of section D. Foam forest-walk 54 comprises an uneven cushioned foam field, resembling a mud slog, through which users may traverse and/or play within. Suspended above ground 55 are foam camo trees 52 (FIG. 2) which provide obstacles with which to play and are decorations in Section D. Vibration sensors 172*a*, of a type which can sense the presence of a child playing or walking nearby, are placed under the foam in foam walk 54.

Sound system 150 is used in conjunction with the above play elements to add sound to the visual effects created. For example, in playing in the recreation system 10 of the present invention, a child may enter section D through first beam walk 44. Upon stepping on beam walk board 44*a*, vibration sensor 172*b* may be activated by the vibration caused by the weight of the child on beam walk board 44*a* signaling sound system 150 to produce the sounds of a board creaking. As the child proceeds across first beam walk 44 and enters foam forest walk 54, motion sensor 170, located in forest bay section 174 may be activated. The activation of sensors 170 may cause sound system 150 to produce background jungle sounds and thunder, and may also cause lightning to be created using rope lights 164 and light fixture 168, all to simulate the sounds and sights of a rain forest. Further, as the child progresses along the path within section D, the presence of the child may trigger vibration sensors 172*a*, causing mud slog noises to be produced as the child enters foam forest 54.

While one example of events triggering the sound system 150 are described, it may be seen that various elements may be rearranged, and such elements as counters and/or timers may be used to trigger certain effects at different times or in response to different or repeated events without departing from the novel scope of the present invention. It is to be further understood that while certain motion and vibration sensing elements have been described and illustrated, the present invention is not limited in this way and other types of electronic and mechanical motion, vibration and trip mechanisms may be used without departing from the novel scope of the present invention.

Figure 10:
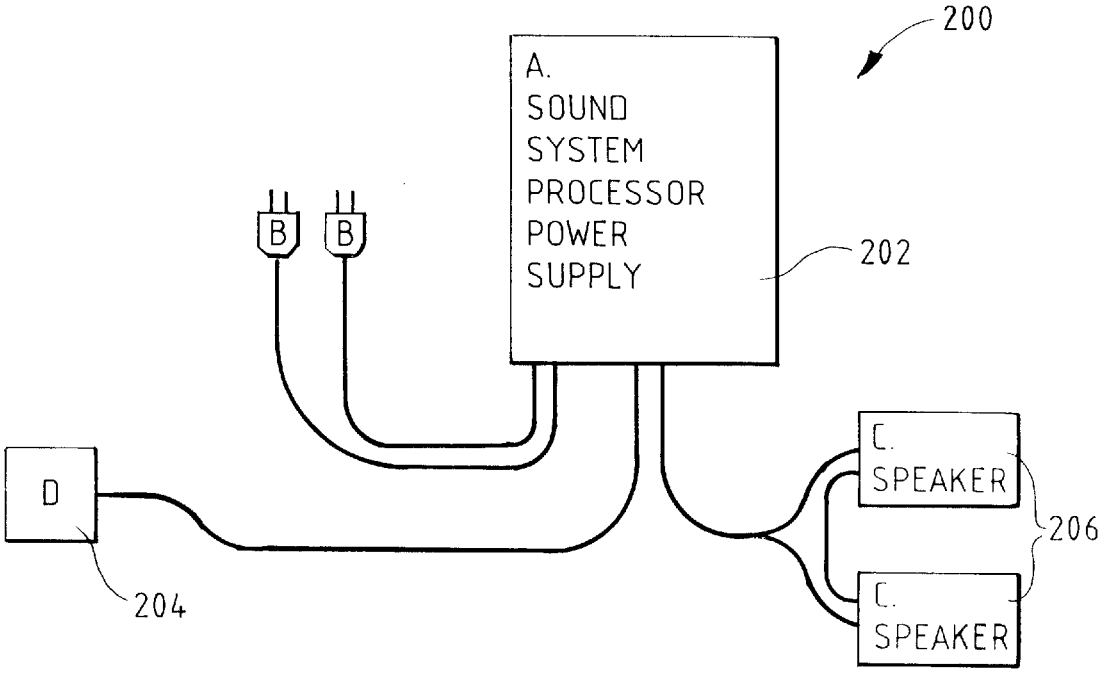
FIG. 10 is a schematic of another sound system used in the recreation system of FIG. 1.
Figure 11:
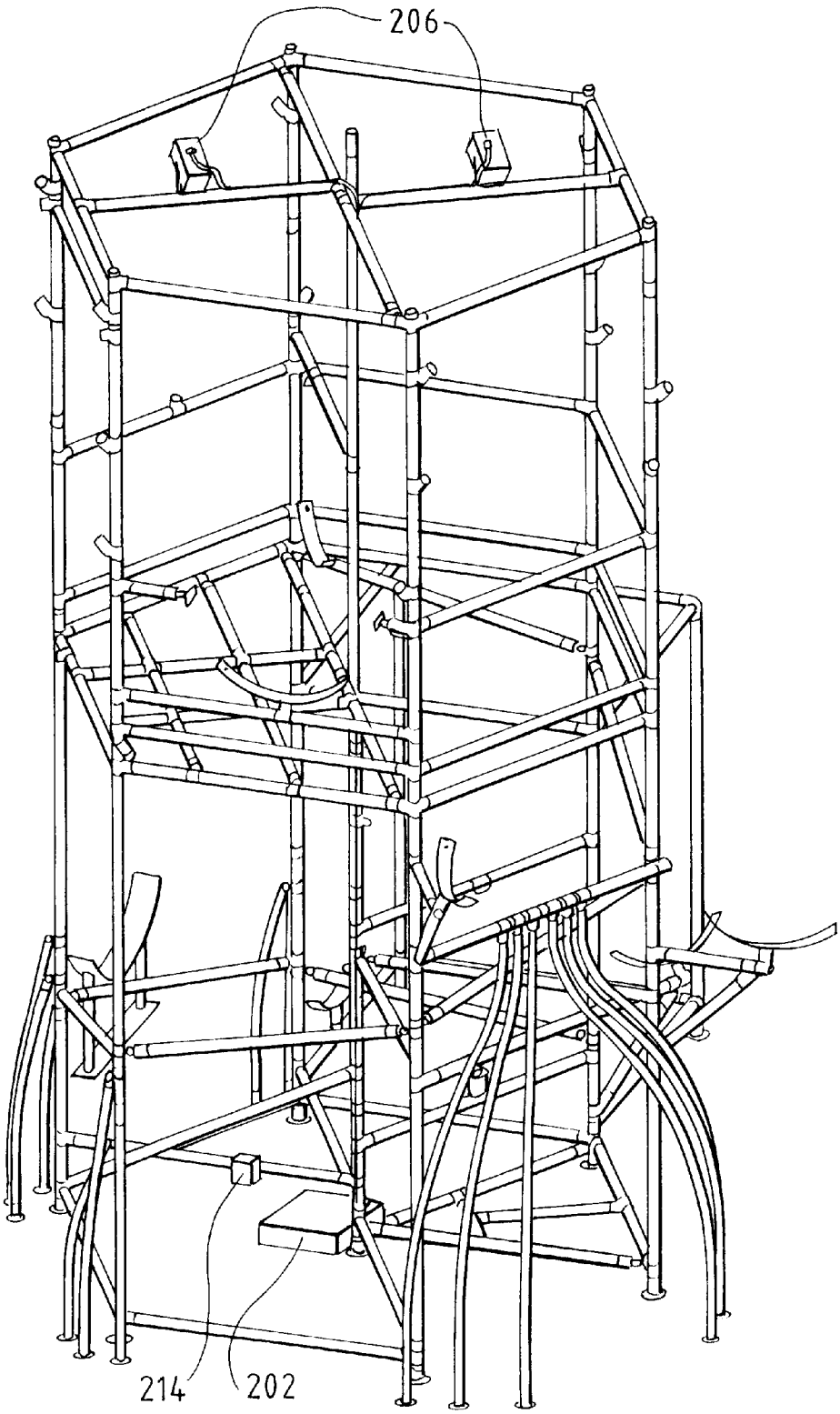
FIG. 11 is a perspective view of the layout of the system of FIG. 10.
Figure 12:
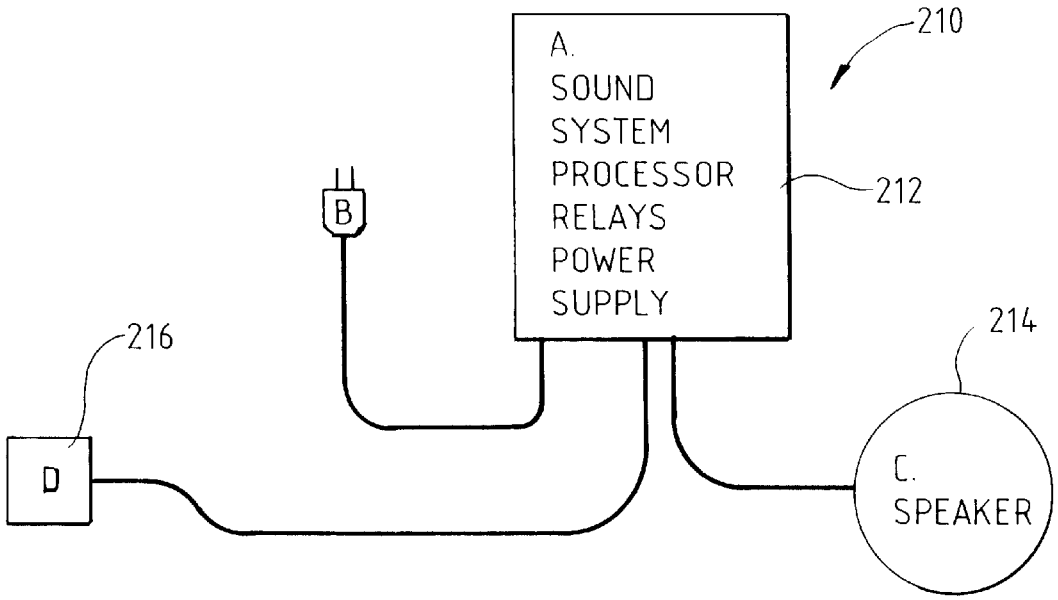
FIG. 12 is a schematic of another sound system used in the recreation system of FIG. 1.
Figure 13:
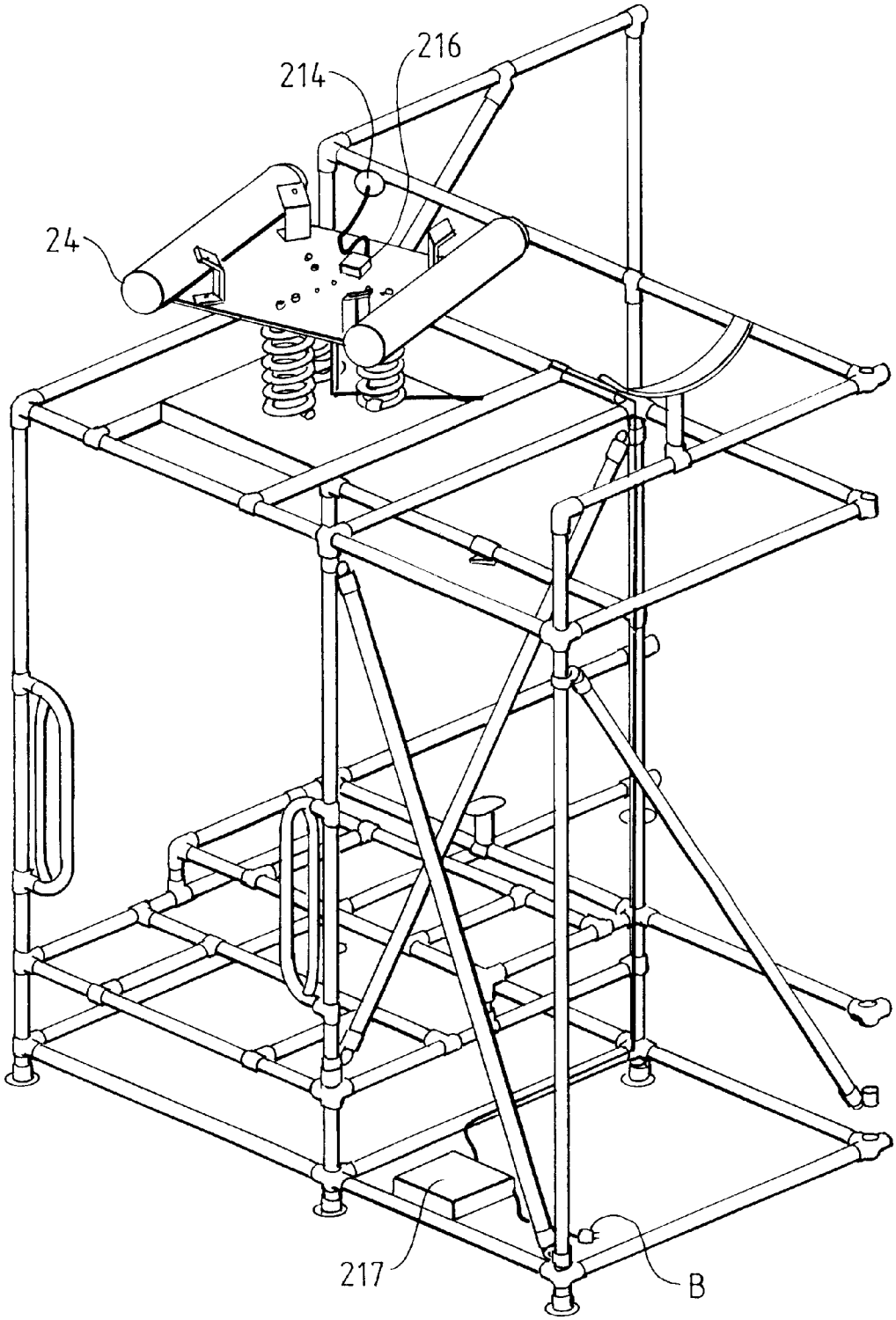
FIG. 13 is a perspective view of the layout of the system of FIG. 12.

FIG. 10 shows a schematic diagram of a second sound system in the present invention, Sound system 200 comprises a sound system box 202, containing a sound processor and power supply (both not shown). As shown in FIG. 11, box 202 may be placed at the base of snake tree section E (FIG. 2) of recreation system 10. A motion detector 204 may also be placed in the base of snake tree section E and connected to box 202. Speakers 206 are provided and may be placed near the top of section E. When the activities of a child playing in section E activate motion sensor 204, sound system box 202 may cause the sounds of birds chirping to be played through speaker 206. In a similar manner, a sound system 210, having a sound system box 212, using speaker 214 and sensor 216, is included in helicopter 24 section F, to produce the sounds of a helicopter when activated by preset criteria such as the presence of a child (as detected by a motion or other sensor) in section F.

As with sound system 150 described above, sound systems 200 and 202 may be triggered by any means set and may include timers and delays to allow sound effects to be produced on a delayed basis or as a result of repeated events, or may be set to occur randomly, without departing from the novel scope of the present invention.

All of these sound systems are shown as examples and may be replaced by any manner of sound and or sound and light system to provide entertainment and assist in the imaginative play of the users without departing from the novel scope of the present invention.

Although illustrative embodiments of the invention have been shown and described, it is to be understood that various modifications and substitutions may be made by those skilled in the art without departing from the novel spirit and scope of the invention.

What is claimed is:

1. A recreation system comprising:

at least one platform for bearing at least one person;

actuatable sensor elements and actuatable sound producing elements, responsive to said sensor elements, such that upon actuation of said sensor elements said sound producing elements can be actuated;

support members elevating said platform above a surface, said support members being extendable above said platform; and, said support members resembling plant parts such that said recreation system resembles a rain forest scene.

2. The recreation system of claim 1, wherein at least one of said sensor elements is a vibration sensor and the presence of a person proximate to said sensor can activate said sound system.

3. The recreation system of claim 1, wherein said at least one of said sensor elements is a motion sensor and the movement of a person proximate to said sensor can activate said sound system.

4. A recreation system comprising:

at least one platform for bearing at least one person;

at least one actuatable sensor element and visual effect producing elements responsive to sensor elements, such that upon actuation of a sensor element a visual effect can be produced;

support members elevating said platform above a surface, said support members being extendable above said platform; and, said support members resembling plant parts such that said recreation system resembles a rain forest scene.

5. The recreation system of claim 4, wherein said visual effect producing elements can include light fixtures which emulate lightning strikes when activated.

6. A recreation system comprising:

a plurality of platforms, each platform capable of bearing at least one person;

a plurality of support members, a number of said support members elevating each of said platforms to a desired height above a surface, said support members being extendable above said platforms;

said support members comprising pipe sections decorated to resemble plant parts, including bamboo plants and trees;

said support members decorated to resemble trees further including decorative materials resembling branches having leaves, tree trunks and tree roots, such that said recreation system resembles a rain forest scene; and, a sound production system including actuatable sensor elements and actuatable sound producing elements, including vibration and motion sensors, said sound production system being responsive to said sensor elements, such that upon actuation of said sensor elements said sound producing elements can be actuated.

7. The recreation system of claim 6, wherein said support members and decorative materials can be assembled together to resemble trees of various shapes.

8. The recreation system of claim 6, wherein said decorative materials comprise a plurality of artificial tree branches each comprised of a at least one tubular padded post having a skeletal structure inserted therein, said tubular padded posts having artificial leaves inserted thereon, said skeletal structure and padded posts being manipulable such that a plurality of tree design configurations can be constructed therefrom.

9. The recreation system of claim 6, including at least one actuatable sensor element and visual effect producing elements, responsive to sensor elements, such that upon actuation of a sensor element a visual effect can be produced.

10. The recreation system of claim 6, wherein said visual effects can include light fixtures which emulate lightning strikes when activated.

* * * * *